United States Patent [19]

Kiedaisch

[11] Patent Number: 4,778,055

[45] Date of Patent: Oct. 18, 1988

[54] DISPLAY CARTON FOR HOLDING UPRIGHT ARTICLES

[75] Inventor: Randall A. Kiedaisch, Bourbonnais, Ill.

[73] Assignee: Manville Corporation, Denver, Colo.

[21] Appl. No.: 25,134

[22] Filed: Mar. 12, 1987

[51] Int. Cl.[4] ..... B65D 5/44

[52] U.S. Cl. ..... 206/563; 229/120.08

[58] Field of Search ..... 206/45.14, 45.15, 45.17, 206/45.19, 45.24, 45.25, 45.28, 45.29, 541, 548, 806, 562, 563; 229/27, 28 R, 29 R, 29 B, 29 C, 29 D, 29 E, 29 F, 167, 173, 904, 120.08

[56] References Cited

U.S. PATENT DOCUMENTS

| | | | |
|---|---|---|---|
| Re. 24,233 | 10/1956 | Goldberg | 229/904 |
| 2,375,843 | 5/1945 | Gottlieb | 206/45.19 |
| 2,464,951 | 3/1949 | Stengren | 206/45.19 |
| 2,670,124 | 2/1954 | Buchmiller et al. | 206/562 |
| 2,924,372 | 2/1960 | Kirkeby | 206/45.19 |
| 2,955,706 | 10/1960 | Emrick | 206/45.14 |
| 3,095,086 | 6/1963 | Berg | 206/45.19 |
| 3,539,089 | 11/1970 | Osberg | 229/27 |
| 3,871,654 | 3/1975 | Bliss | 229/27 |
| 3,907,108 | 9/1975 | Weimer, Jr. | 229/27 |
| 4,111,299 | 9/1978 | Taub | 229/27 |
| 4,570,787 | 2/1986 | Forbes, Jr. | 206/45.14 |

FOREIGN PATENT DOCUMENTS

| | | | |
|---|---|---|---|
| A080740 | 4/1963 | France | 229/167 |

*Primary Examiner*—Jimmy G. Foster

*Attorney, Agent, or Firm*—John D. Lister; Cornelius P. Quinn

[57] ABSTRACT

A display carton for holding articles such as picnic plates and one or more different types of cups. The top and front panels contain cutouts which hold the cups in place and permit them to be seen in the display carton. The top panel is spaced from the back panel a distance permitting picnic plates to be held upright between them. An additional panel foldably connected to the back edge of the top panel extends down to the bottom panel and a short flap foldably connected to the additional panel extends to the back panel to frictionally hold the top panel in place.

8 Claims, 3 Drawing Sheets

DISPLAY CARTON FOR HOLDING UPRIGHT ARTICLES

FIELD OF THE INVENTION

This invention relates to display cartons. More particularly, it relates to a display carton for holding relatively thin articles on edge while having the capability to carry and display other articles of different shape.

BACKGROUND OF THE INVENTION

Display cartons are used to package articles so that shoppers can view the contents of the carton without opening it. Many different types of articles are packaged in this way, usually requiring different carton designs for each different type of product. Products of unusual size or shape can make the task of designing a display carton very difficult, especially when the package should be as compact and inexpensive as possible and yet present the articles in an attractive, appealing manner. When products of different size and shape are packaged in the same display carton the problems are understandably multiplied.

Despite the problems encountered in packaging different types of products in the same display carton, there are some groups of different but related products which should be packaged together if at all possible. For example, picnic plates and cups are generally bought at the same time, but because of their greatly different size and shape are usually packaged in separate cartons. It would be desirable to package both the plates and cups in the same display carton so that customers would be able to view the entire set together. The cost of such an arrangement, however, must be low enough to make the display carton practical.

BRIEF SUMMARY OF THE INVENTION

This invention provides a display carton having front, back and end panels foldably connected to a bottom panel. A top panel foldably connected to the front panel terminates short of the back panel. The space between the front and back panels is adapted to receive relatively thin articles standing on edge, and the space in the interior of the carton bounded by the front, end and top panels is adapted to receive articles of different shape. The top panel may contain a cutout through which the upper portions of the different shaped articles can protrude, and the front panel may contain a cutout through which the articles can be viewed. In addition, means are provided to hold the top panel in place in spaced relationship to the back panel.

The design of the display carton permits the carton to be fabricated quite inexpensively, as will be explained further herienafter.

Other features and aspects of the invention, as well as its various benefits, will be made clear in the more detailed description of the invention which follows.

DESCRIPTION OF THE INVENTION

Figure 1:
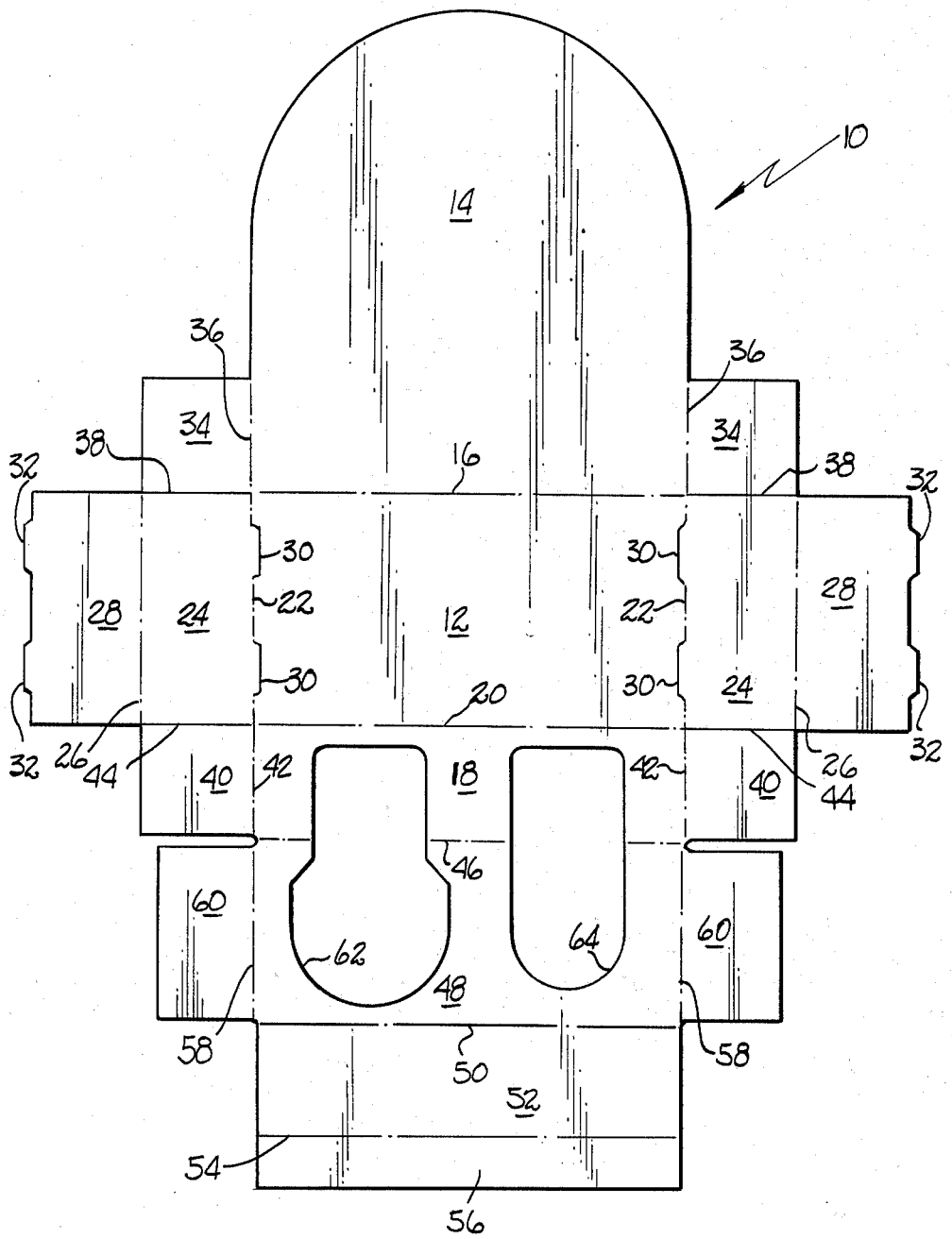
FIG. 1 is a plan view of a production blank from which the display carton of the present invention can be fabricated.

Referring to FIG. 1, a display carton blank 10, typically formed of paperboard, comprises a bottom panel portion 12 connected to a relatively large back panel portion 14 along fold line 16, and to a relatively short front panel portion 18 along fold line 20. Also connected to the bottom panel portion 12 along fold lines 22 are end panel portions 24, which in turn are connected by fold lines 26 to end flaps 28. The fold lines 22 contain two slits 30 which extend slightly inwardly into the bottom panel portion 12, and the end flaps 28 contain two short tabs 32 adapted to be inserted into the slits 30 in a manner to be explained hereinafter.

Dust flaps 34 are foldably attached to the back panel portion 14 along fold lines 36, which are generally extensions of the fold lines 22. The dust flaps are separated from the end panel portions 24 by slits 38, which are generally extensions of the fold line 16. Similarly, dust flaps 40 are foldably connected to the front panel portion 18 along fold lines 42, which are also generally extensions of the fold lines 22. The dust flaps 40 are separated from the end panel portions 24 by slits 44.

Connected to the front panel portion 18 along fold line 46 is top panel portion 48, which at its opposite end is connected along fold line 50 to intermediate back panel portion 52. The intermediate back panel portion 52 in turn is connected at its opposite end along fold line 54 to locking flap 56. The purpose of this arrangement will be made clear hereinafter.

Connected to the ends of the top panel portion 48 along fold lines 58 are top panel end flaps 60. Spaced inwardly from the fold lines 42 and 58 is a cutout 62 which extends through portions of both the front panel portion 18 and the top panel portion 48. The purpose of the cutout is to hold in place articles positioned in the interior of a carton formed from the blank 10 and to permit the articles to be viewed on display. In like manner a generally similar but smaller cutout 64 is inwardly spaced from the other fold lines 42 and 58 to hold smaller articles in place and to permit them to be viewed.

Figure 2:
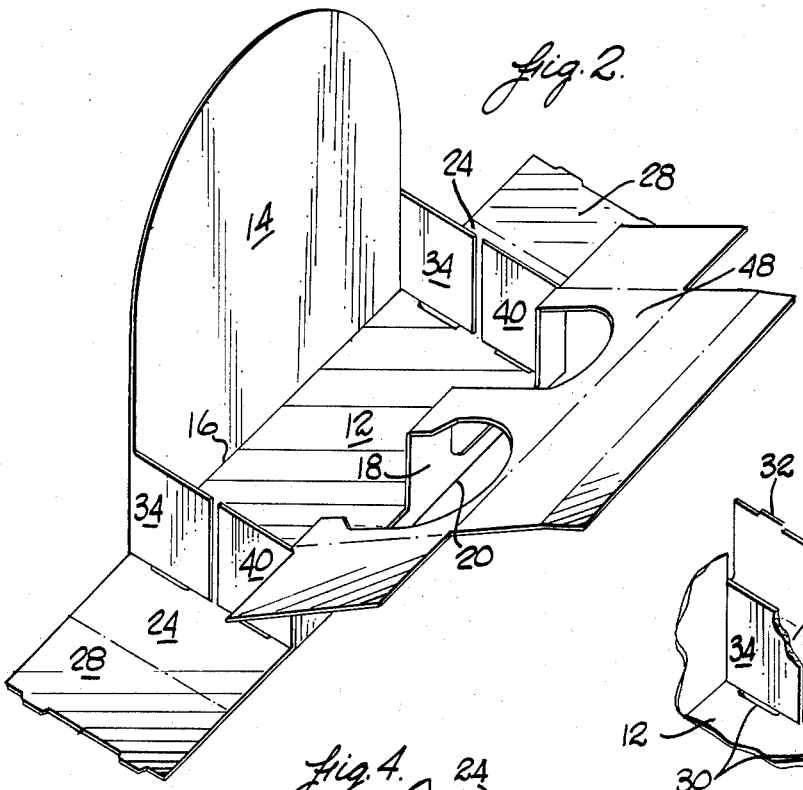
FIG. 2 is a pictorial representation of the blank of FIG. 1, showing the front and back panels and the dust flaps in folded condition.

Referring to FIG. 2, the blank is shown in the first steps of being folded into carton form. The back panel 14 has been folded up about fold line 16, and the front panel 18 has been folded up about fold line 20. Also, dust flaps 34 and 40 have been folded in about their fold lines 36 and 42, respectively, to lie in a plane substantially at right angles to the front and back panels. The end panel portions 24 and the end flaps 28 at this stage are still in their flat unfolded condition.

Figure 3:
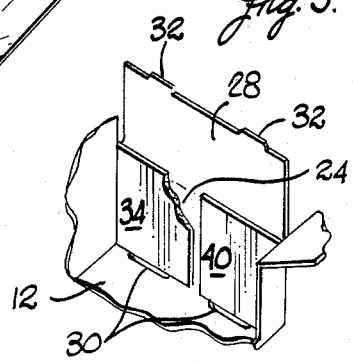
FIG. 3 is a pictorial representation of one of the end panels of the carton as it would appear in an interim stage of formation.
Figure 4:
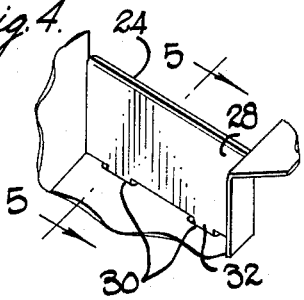
FIG. 4 is a view similar to that of FIG. 3, but showing the end panel after it has been fully formed.
Figure 5:
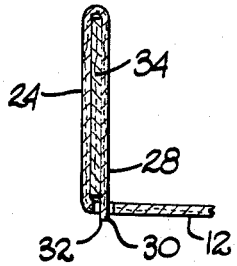
FIG. 5 is a transverse sectional view of the end panel taken on line 5—5 of FIG. 4.

As shown in FIG. 3, which illustrates one of the end panels at the next stage of its formation, after the dust flaps 34 and 40 have been folded in toward each other, the end panel 24 is folded up against the outer faces of the dust flaps. As shown in FIG. 4, the next step is to fold the end flap 28 down against the inner faces of the dust flaps. The short tabs 32 extending from the ends of the end flaps 28 mate with the slits 30 in the bottom panel 12 to lock the end panel construction in place. The resulting configuration is illustrated in FIG. 5, wherein the dust flap 34 is shown to be sandwiched between the end panel 24 and the end flap 28. It will be understood that the opposite end panel would be of the same construction.

Figure 6:
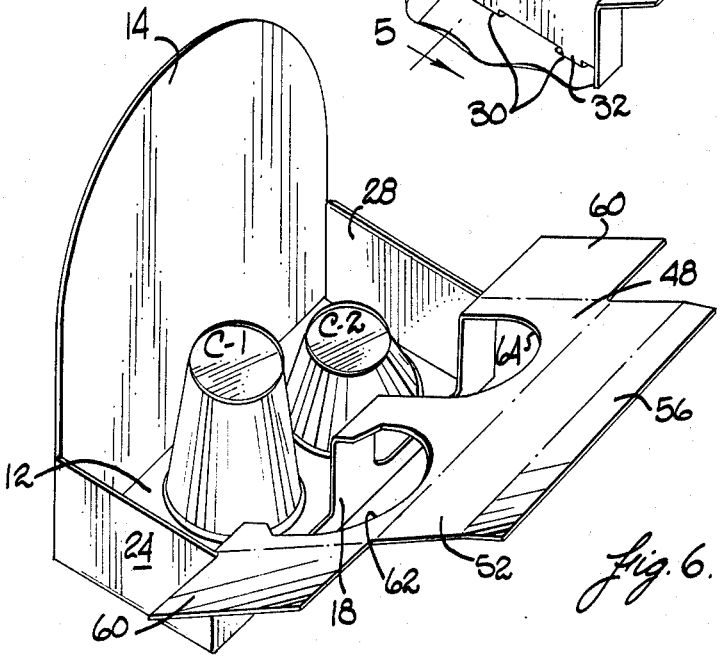
FIG. 6 is a pictorial representation of the next step in fabricating the display carton of the present invention following the formation of the end panels.

Referring now to FIG. 6, the partially formed carton is shown after the end panel construction has been formed but before the front and top panels 18 and 48 have been fixed in place. At this stage, the articles to be contained in the interior of the carton are placed on the bottom panel prior to folding the top panel down to cover the interior space. Thus, in using the display carton of the present invention to package paper or plastic cups, the cups C1 and C2 are placed on the bottom panel 12 in alignment with the cutouts 62 and 64 in the front and top panels. As illustrated, the cups C1, which typically would be drinking cups, are the larger of the two sizes and are arranged in stacked condition aligned with the larger cutout 62. The smaller cups C2, which typically would be fruit cups, are arranged in a stack in alignment with the smaller cutout 64. The number of cups to be packaged obviously may vary. Eight cups in a stack would be a common arrangement.

Figure 7:
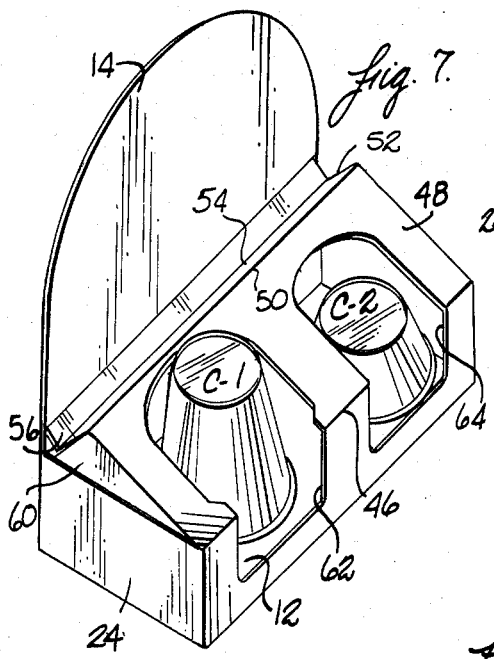
FIG. 7 is a view similar to that of FIG. 6, but showing the top panel as it is being moved into locking position over stacks of cups to be contained in the carton.

As shown in FIG. 7, the next step in the formation of the display carton is to fold the top panel 48 down about its fold line 46. The top panel end flaps 60 would first have been folded down about their fold lines 58 to form a right angle with the top panel in order to fit inside the end panel structure when the top panel is folded down. During this step, the narrower portions of the stacked tapered cups may penetrate the cutouts in the top panel to protrude therethrough. The dimensions of the cutouts are coordinated with the dimensions of the cups so that there is not enough space surrounding the protruding cup to allow the wider portion of the cup located beneath the top panel to pass through the cutout. The cups are thus hold in place inside the carton.

Still referring to FIG. 7, the intermediate back panel 52 is then folded down about its fold line 50 and the locking flap 56 is folded up about its fold line 54 prior to moving the intermediate back panel and the locking flap into their final positions. Continued movement of the top panel down into place will move the intermediate back panel into a vertical position spaced from the back panel 14 a distance substantially equal to the width of the locking flap 56. The intermediate back panel 52 thus forms the back wall of the carton interior in which the cups are located, and the space between the back panel 14 and the intermediate back panel 52 is the space in which the thin articles, such as paper or plastic plates, can be stacked on edge.

Figure 8:
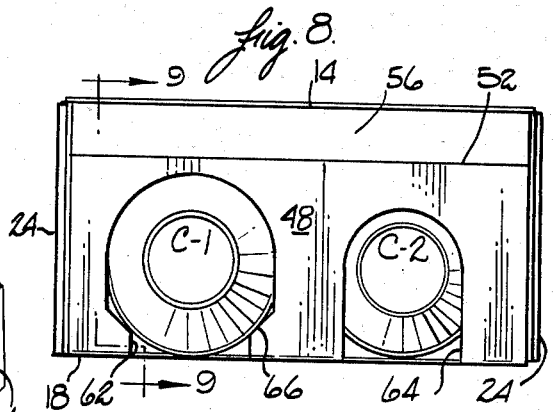
FIG. 8 is a plan view of the display carton of the present invention after it has been fully formed.
Figure 9:
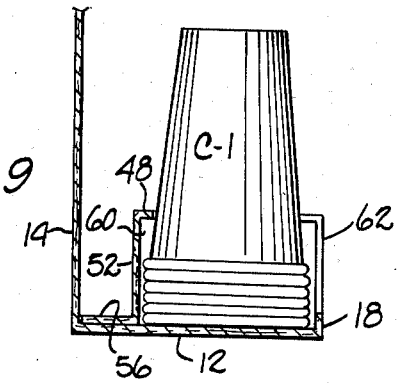
FIG. 9 is a transverse sectional view of the carton, taken along line 9—9 of FIG. 8, showing a stack of cups supported therein.

This arrangement is more clearly depicted in FIGS. 8 and 9, which show the carton after it has been fully erected with the cups C1 and C2 contained therein. Although for purpose of clarity the storage space between the back panel 14 and the intermediate back panel 52 is shown to be empty, it should be understood that the space is ready to receive articles to be displayed. As best illustratd in FIG. 8, the base portions of the tapered cups C1 and C2 protrude through the top panel 48 but the wider portions adjacent the rims of the cups do not. This arrangement allows the cups to extend upwardly for a limited distance for display purposes, but keeps the cups from falling out of the carton. The shoulder portions 66 on the cutout associated with the larger cups C1 result in the top panel 48 having a wider portion between the end panel 24 and the cutout 62 than would be the case if the cutout were to extend straight out to the front panel 18 in the manner of the cutout 64. This precludes an area of potential weakness from developing along the fold line between the top and front panels when a wide cutout is provided.

FIG. 9 more clearly shows the locking flap 56 extending from the bottom of the intermediate back panel 52 into contact with the back panel 14. The combination of the flap width, the flexibility of the paperboard flap, and the biasing tendency of the fold 50 to push the intermediate back panel 52 toward the back panel 14 creates a frictional wedging action between the flap and the back panel. This wedging mechanism holds the entire front, top and intermediate back panel assembly securely in place. Also visible in this view is the far top panel end flap 60, the back edge of which acts as a backing or support for the intermediate back panel 52. The near top panel end flap, not visible in the view, also provides a similar function. The cutout in the front panel terminates short of the bottom panel to provide a lip which prevents the cups from extending through the cutout beyond the front panel.

Figure 10:
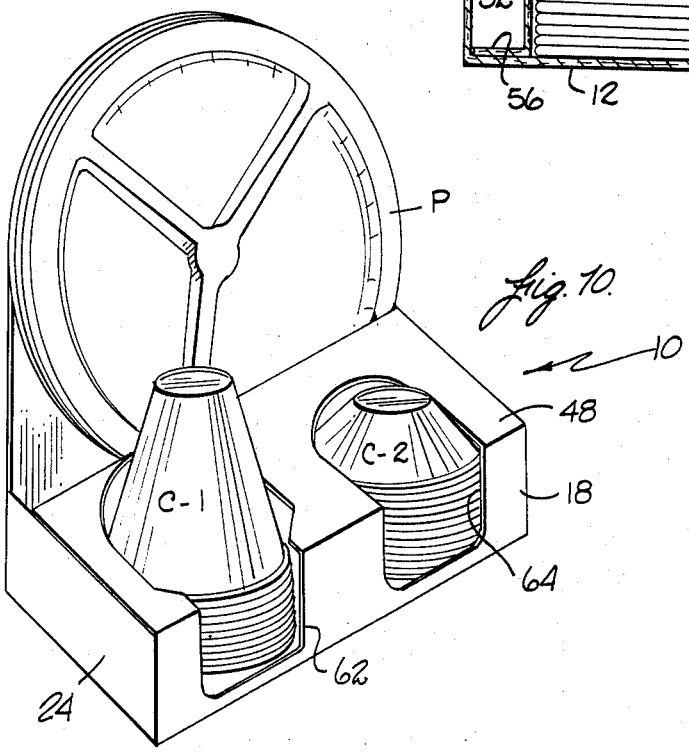
FIG. 10 is a pictorial representation of the fully fabricated display carton of the present invention, showing a stack of plates supported on end between the top and back panels and also showing stacks of two different sizes of cups in the interior of the carton.

As shown in FIG. 10, the display carton 10 when erected and loaded with a set of picnic plates and cups would contain two different sizes of cups C1 and C2 as well as plates P, standing on edge and supported on the bottom panel in the space between the back panel and the intermediate back panel. The back panel can be any convenient height, provided it is tall enough to afford adequate support for the plates.

It should now be clear that the present invention provides a carton that can contain and hold in place different sizes of cups as well as a stack of plates, while displaying the contents to customers. The carton is inexpensive to produce, being fabricated from a minimum of paperboard material without costly time consuming gluing operations. It is held in erected form by a novel frictional wedging support arrangement which creates the plate receiving space between the back panel of the carton and the intermediate back panel. Obviously, if desired, the cup sizes can be the same and the number of stacks of cups and corresponding cutouts is not limited to two.

It should be obvious that although a preferred embodiment of the invention has been described, changes to certain specific details of the preferred embodiment can be made without departing from the spirit and scope of the invention.

What is claimed is:

1. A display carton, comprising:

a front panel;

a back panel;

a bottom panel foldably connected to the front and back panels;

side panels foldably connected to the bottom panel;

a top panel foldably connected to the front panel and terminating short of the back panel;

an additional panel foldably connected to the back of the top panel and extending downwardly toward the bottom panel;

means adjacent the bottom of the additional panel for holding the additional panel in place;

the distance between the additional panel and the back panel being relatively small compared to the width of the top panel to form a relatively narrow space between the additional panel and the back panel;

the back panel extending substantially higher than the top panel whereby the back panel is adapted to assist in supporting one or more relatively tall narrow articles positioned in the space between the additional panel and the back panel;

the carton being adapted to contain one or more relatively short articles having relatively narrow upper portions and relatively wide lower portions, the top panel containing at least one cutout through which the relatively narrow upper portion of one or more of the relatively short articles may extend, the cutout being narrower than the width of the relatively wide lower portion to prevent said articles from being removed from the carton through the cutout; and the front panel containing a cutout generally aligned with the cutout in the top panel, enabling the relatively short articles to be seen through the front panel as well as through the top panel.

2. A display carton according to claim 1, wherein the cutouts in the front and top panels extend to the juncture of the front and top panels to connect with each other.

3. A display carton according to claim 2, wherein the width of the cutout in the front panel is less than the width of the relatively wide lower portions of the relatively short articles.

4. A display carton according to claim 1, wherein the carton is adapted to receive relatively short articles in the form of a stack of tapered cups, the upper cup in the stack extending through the cutout in the top panel while lower portions of the stack can be viewed through the cutout in the front panel.

5. A display carton according to claim 4, wherein the top and front panels contain at least two generally aligned cutouts.

6. A display carton, comprising:

a front panel;

a back panel;

a bottom panel foldably connected to the front and back panels;

side panels foldably connected to the bottom panel;

a top panel foldably connected to the front panel and terminating short of the back panel;

an additional panel foldably connected to the back of the top panel and extending downwardly toward the bottom panel;

means adjacent the bottom of the additional panel for holding the additional panel in place;

the distance between the additional panel and the back panel being relatively small compared to the width of the top panel to form a relatively narrow space between the additional panel and the back panel;

the back panel extending substantially higher than the top panel whereby the back panel is adapted to assist in supporting one or more relatively tall narrow articles positioned in the space between the additional panel and the back panel;

the carton being adapted to contain one or more relatively short articles having relatively narrow upper portions and relatively wide lower portions, the top panel containing at least one cutout through which the relatively narrow upper portion of one or more of the relatively short articles may extend, the cutout being narrower than the width of the relatively wide lower portion to prevent said articles from being removed from the carton through the cutout; and the means for holding the additional panel in place comprising a flap foldably connected to the bottom of the additional panel and extending to the back panel, whereby the additional panel is held in place by the friction fit of the flap against the back panel.

7. A display carton according to claim 6, further including side flaps foldably connected to the side edges of the top panel and extending downwardly toward the bottom panel, at least portions of the back edges of the side flaps contacting the face of the additional panel which is opposite the relatively narrow space.

8. A display carton according to claim 6, wherein the additional panel is substantially parallel to the back panel.

* * * * *